US006243868B1

(12) United States Patent
Wanzenried

(10) Patent No.: US 6,243,868 B1
(45) Date of Patent: Jun. 12, 2001

(54) FINGER TIP PROTECTORS

(76) Inventor: Ernest Wanzenried, 3758 Ellwood Rd., New Castle, PA (US) 16101

( * ) Notice: Subject to any disclaimer, the term of this patent is extended or adjusted under 35 U.S.C. 154(b) by 0 days.

(21) Appl. No.: 09/394,035

(22) Filed: Sep. 13, 1999

Related U.S. Application Data

(60) Provisional application No. 60/102,683, filed on Oct. 1, 1998.

(51) Int. Cl.[7] ..... A41D 13/00

(52) U.S. Cl. ..... 2/21; 294/25

(58) Field of Search ..... 2/21, 160, 163; 128/880; 294/25; 401/7, 8; 602/22; 473/54, 60; D29/113

(56) References Cited

U.S. PATENT DOCUMENTS

| | | | | |
|---|---|---|---|---|
| D. 334,085 | * | 3/1993 | Niemann | D29/20 |
| 2,379,624 | * | 7/1945 | Chisnell | 2/21 |
| 2,389,831 | * | 11/1945 | Welsh | 2/21 |
| 2,474,535 | * | 6/1949 | Krannak | 2/21 |
| 2,847,005 | * | 8/1958 | Bourne | 2/21 |
| 3,228,033 | | 1/1966 | Ames et al. . | |
| 3,263,682 | | 8/1966 | Rosenfield . | |
| 3,348,541 | * | 10/1967 | Loebeck | 2/21 |
| 4,796,302 | | 1/1989 | Davis et al. . | |
| 5,267,945 | * | 12/1993 | Doctor et al. | 602/14 |
| 5,517,692 | | 5/1996 | Wunderlich-Kehm . | |
| 5,577,272 | | 11/1996 | Fisher . | |
| 6,012,165 | * | 1/2000 | Cain | 2/21 |

FOREIGN PATENT DOCUMENTS

| | | |
|---|---|---|
| 22069 | 1/1906 | (GB) . |

* cited by examiner

*Primary Examiner*—John J. Calvert
*Assistant Examiner*—Kate Moran
(74) *Attorney, Agent, or Firm*—Craig G. Cochenour; Suzanne Kikel

(57) ABSTRACT

A fingertip protector comprises a sleeve adapted to fit over a finger of a wearer, and a flexible strip. The sleeve has an opening for the insertion of a finger, and a portion of strip is attached to the part of the circumference of the opening. An adhesive backing on the inner surface of the strip is present to secure the protector to the finger and the remainder of the circumference of the opening, and a release liner is releasably affixed to the adhesive backing, which is designed for removal before use. In an alternative embodiment, the fingertip protector is snugly secured to the finger by strips of hook and loop fastening material disposed about the circumference of the open end of the sleeve.

1 Claim, 4 Drawing Sheets

FINGER TIP PROTECTORS

CROSS-REFERENCE TO RELATED APPLICATION

This application claims the benefit of U.S. Provisional Patent Application Serial No. 60/102,683, filed Oct. 1, 1998.

BACKGROUND OF THE INVENTION

1. Field of the Invention

The present invention relates to fingertip protectors and, more particularly, to fingertip protectors that may be removably and adhesively affixed about a wearer's finger; I prefer to name these "Clean Tips" fingertip protectors.

2. Description of Related Art

Protective devices that are affixed to a user's fingertips are taught in the related art. One such invention is disclosed in U.S. Pat. No. 2,379,624 which issued to J. B. Chisnell on Jul. 3, 1945. This invention teaches an elastomeric finger guard for receiving on a finger, but does not teach an adhesive material for affixing the guard on the finger.

U.S. Pat. No. 2,389,831 which issued to S. J. Welsh on Nov. 27, 1945, discloses a prophylactic sheath or envelope with a band of adhesive coating arranged about the open end thereof. The invention additionally has a strip of gauze releasably affixed to the band of adhesive coating. The sheath or envelope is described as being elastic. Similarly, U.S. Pat. No. 2,474,535 which issued to S. J. Krannak on Jun. 28, 1949, discloses a protective cot for attachment over a nose or finger. A strip of adhesive encircles the open end thereof for attachment to the desired body part.

U.S. Pat. No. 3,228,033 which issued to Ames et al. on Jan. 11, 1966, discloses a one-piece guard for use on a user's two fingers for preventing puncturing of a baby's skin when the user is pinning diapers on a baby.

U.S. Pat. No. 3,263,682 which issued to B. Rosenfield on Aug. 2, 1966, discloses a rolled finger bandage having a proximal and a distal end and intermediate twist, wherein the distal end may be retroverted over the proximal end to create a double-ply bandage.

U.S. Pat. No. 3,348,541 which issued to G. J. Loebeck on Oct. 29, 1965, discloses a finger bandage having a sterile lining and an adhesive flap for securing to the finger.

U.S. Pat. No. 4,796,302 which issued to Davis et al. on Jan. 10, 1989, discloses a finger and thumb protector for use when hammering nails. The invention comprises a pair of longitudinal sheaths pivotally connected, each sheath having a depression for holding a nail.

U.S. Pat. No. 5,517,692 which issued to J. Wunderlich-Kehm on May 21, 1996, discloses flexible devices that protect a manicurist's thumb and finger from chafing and irritation from repeated contact with a nail file. Each device attaches about a finger with hook-and-loop-type fastening fabric.

U.S. Pat. No. 5,577,272 which issued to O. C. Fisher on May 30, 1996 disclose finger sleeves of varying length that extend beyond a user's finger in order to facilitate one-handed basketball dunks.

Lastly, British Patent No. 22,069, published Jan. 11, 1906, discloses a rubber finger sheath having thin walls near the finger-joint portion thereof.

None of the above inventions and patents, taken either singly or in combination, is seen to describe the instant invention as claimed.

SUMMARY OF THE INVENTION

The present invention provides a fingertip protector to protect the fingertips of a wearer engaged in dirty or abrasive environments. When working in gardens or on automobile engines, dirt or grease tends to become trapped under the fingernails or cuticles of the wearer. When using the fingertip protectors of the present invention, dirt and grease are prevented from soiling the wearer's fingers.

The fingertip protector comprises a sleeve adapted to fit over a finger of a wearer, and a strip. The sleeve has an opening for the insertion of a finger, and one end of the strip is attached to a portion of the circumference of the opening. An adhesive backing on the inner surface of the strip is present to secure the protector to the finger and the remainder of the circumference of the opening of the sleeve, and a release liner is releasably affixed to the adhesive backing, which is designed for removal before use. Once used, the protectors may be discarded.

In an alternative embodiment, the sleeve has a strip of hook and loop fastening material extending about three-quarters of the circumference of the opening of the sleeve with the fastening material facing outward, and a second strip of hook and loop fastening material attached to the sleeve between the ends of the first strip. The second strip of hook and loop fastening material has the fastening material facing inward, and is elongated so that it may be wrapped snugly around the outside of the sleeve in order to take up any slack between the sleeve and the finger, being fastened to the first strip of hook and loop material.

Accordingly, it is a principal object of the invention to provide a fingertip protector that prevents a wearer's finger from buildup of dirt and debris under the wearer's fingernails It is another object of the invention to a fingertip protector that protects a wearer's fingertip from damage due to the handling of sharp or abrasive material.

It is a further object of the invention to provide a fingertip protector that may be securely fastened to a wearer's fingertip.

Still another object of the invention is to provide a fingertip protector which is reusable by providing the protector with hook and loop fastening material.

It is an object of the invention to provide improved elements and arrangements thereof in an apparatus for the purposes described which is inexpensive, safe, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
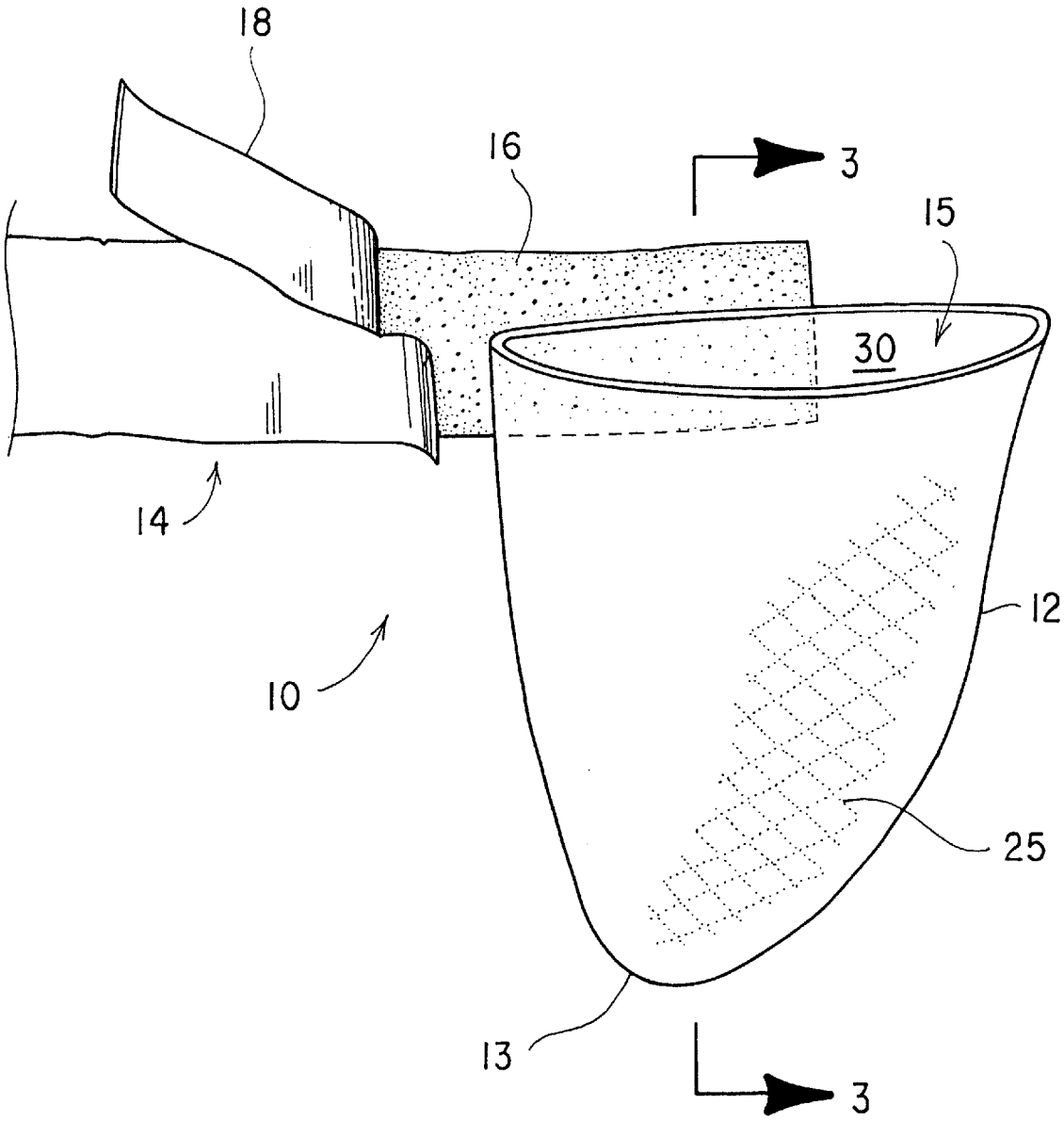
FIG. 1 is a perspective view of a fingertip protector according to the present invention, showing the release liner partially pulled away to expose the adhesive backing.

Referring now to the drawings wherein like numerals represent like elements, FIG. 1 shows a fingertip protector 10 according to the preferred embodiment of the present invention. The protector 10 comprises an elastomeric sleeve 12 having an open end 15 and a closed end 13. A flexible, elongated, generally rectangular strip 14 has a proximal end and a distal end, the proximal end being fixedly attached to the exterior of the sleeve 12, the strip 14 being elongated and aligned to wrap about the circumference of the open end 15. The sleeve 12 has an outer surface which may be embossed with a non-skid pattern 25 to assist in gripping of objects. The sleeve 12 is ideally constructed of latex, but may be made from other thermoplastic material. For example, rubberized canvas may be used for working with abrasive materials such as concrete. The inner surface 30 is textured, having a low coefficient of friction, so that a finger may slip easily into the sleeve 12.

Figure 2A:
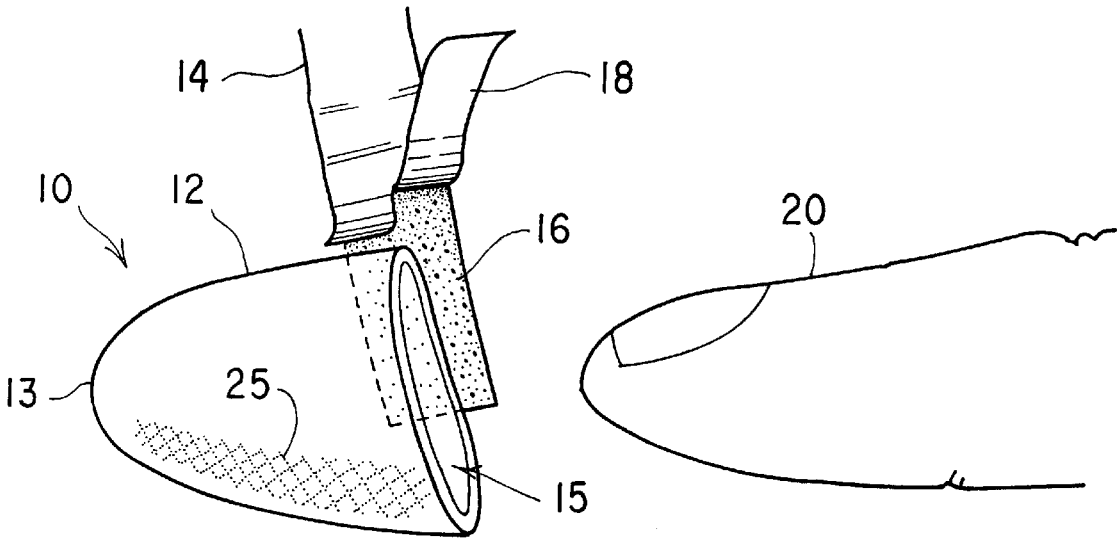
FIG. 2A is an environmental perspective view of the present invention prior to its placement over a finger.
Figure 2B:
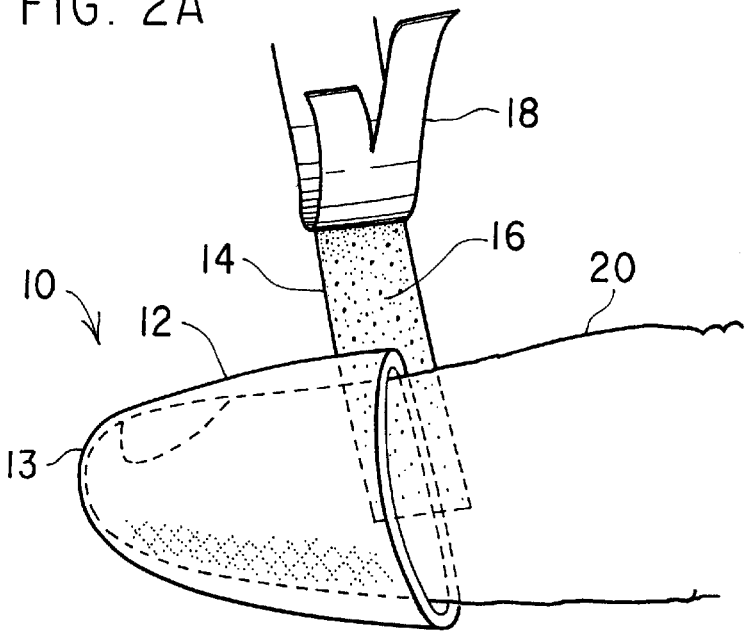
FIG. 2B is an environmental perspective view of the present invention showing a finger in phantom lines.
Figure 2C:
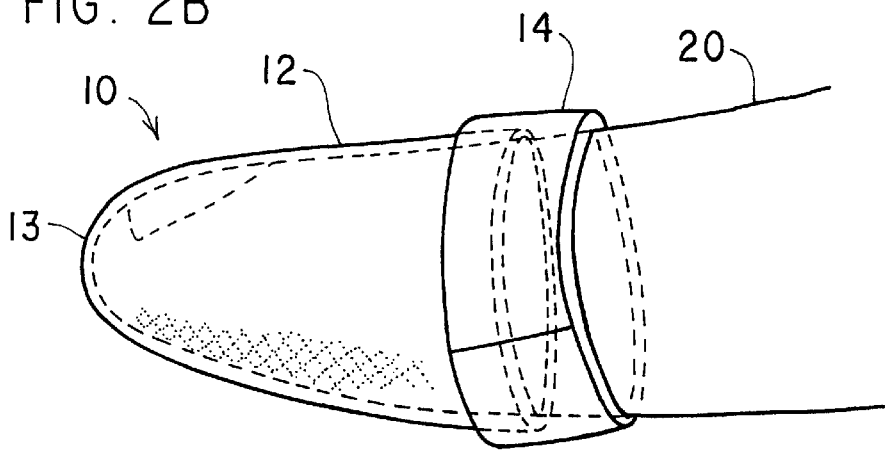
FIG. 2C is an environmental perspective view of the present invention shown placed over a finger.
Figure 3:
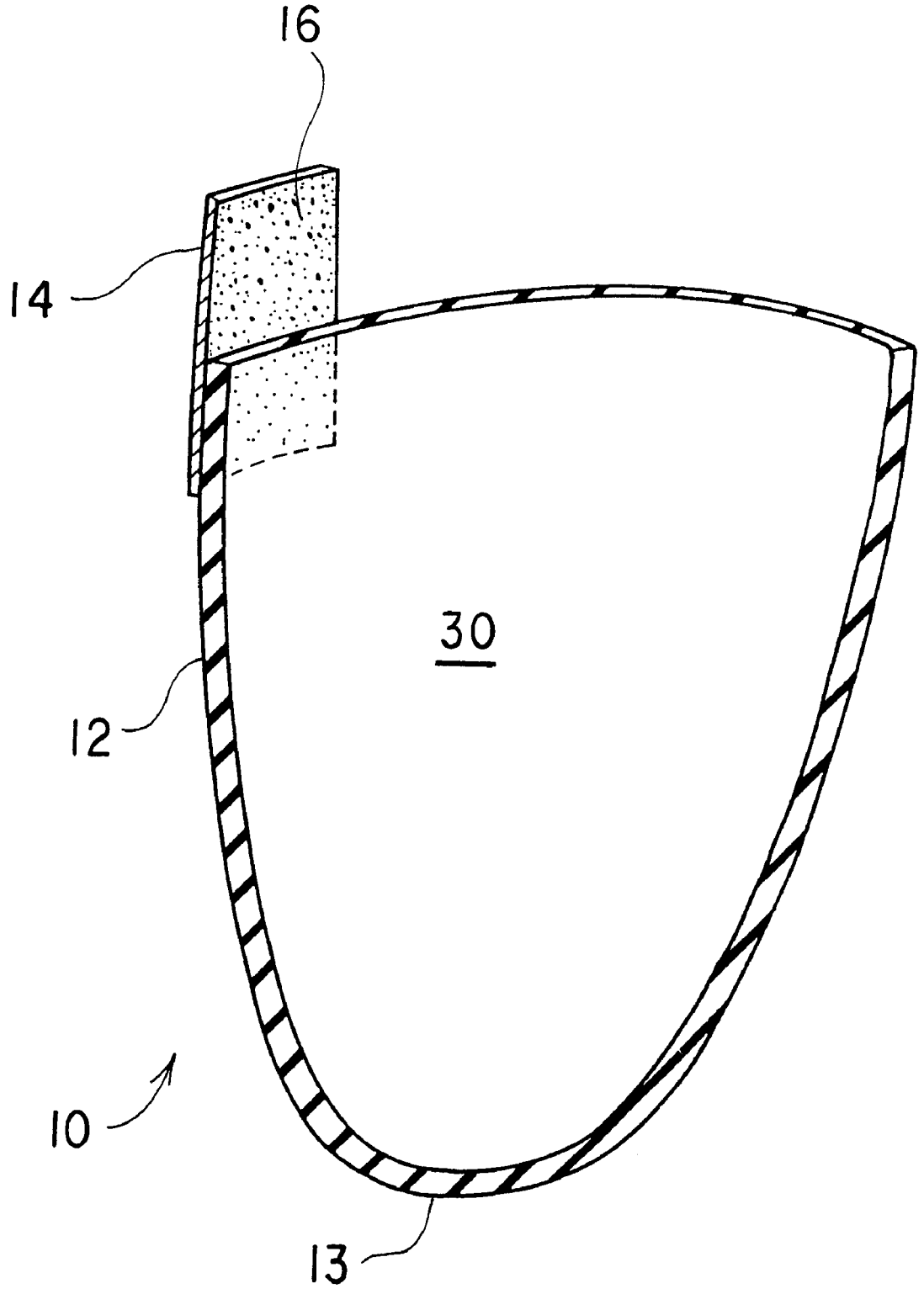
FIG. 3 is a section view of the present invention, drawn along lines 3—3 of FIG. 1.

Referring to FIGS. 1–3, the strip 14 has an inner surface that: has adhesive backing 16 affixed thereto, which serves to fixedly attach the proximal end of the strip to the sleeve 12. The width of the strip 14 is such that approximately one-half of the strip 14 is below the open end 15, and the other half extends above the open end 15 of the sleeve 12. The strip 14 is supplied with a release liner 18 removably affixed to the adhesive backing 16 of the distal portion of the strip 14.

Referring now to FIGS. 2*a*–2*c*, the method of affixing the protector 10 to a finger 20 will be described. The wearer first inserts a finger 20 into the open end 15 of the sleeve 12. The wearer then removes the release liner 18 from the strip 14, thereby exposing the adhesive backing 16 thereof. The wearer then wraps the distal portion of the strip 14 about the finger 20 and the rest of the circumference of the open end 15, ensuring that one half of the adhesive backing 16 of the strip contacts the sleeve 12 and the other half of the adhesive backing contacts the finger. The wearer then presses the adhesive backing 16 to the finger 20 and the sleeve 12, thereby securing the protector 10 to the finger. To ensure a tight fit, there should be a one-quarter overlap of the strip 14 when secured. The wearer may then work in dirty environments without concern of dirt being trapped in fingernails or cuticles. After use, the protectors 10 may be discarded.

Advantageously, the smooth, textured inner surface makes it easier for the wearer to place the protector 10 on his finger, unlike sleeves which rely upon an elastic fit, or which have a layer of adhesive affixed to the inner surface of the sleeve.

Figure 4:
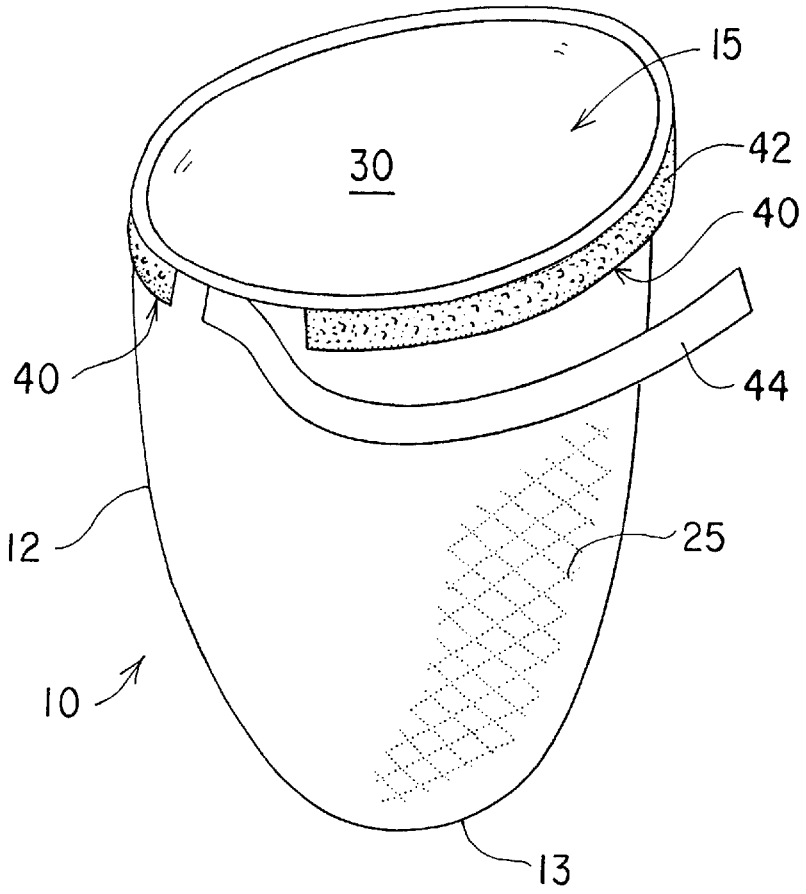
FIG. 4 is a perspective view of an alternative embodiment or the fingertip protector.
Figure 5:
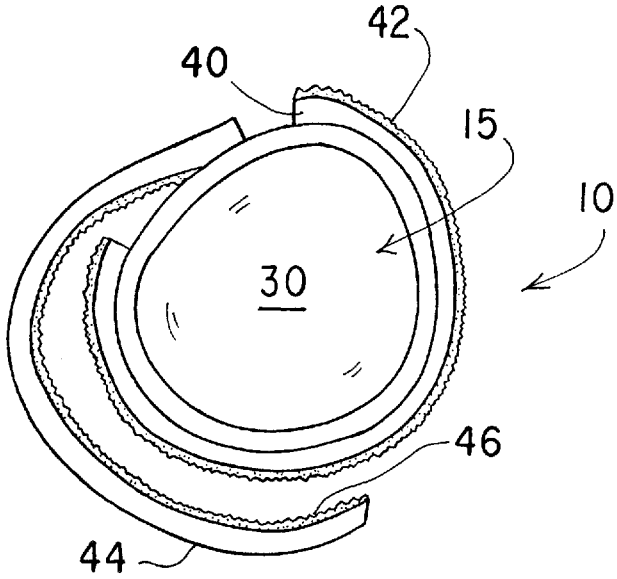
FIG. 5 is a top view of the embodiment shown in FIG. 4.

FIGS. 4 and 5 illustrate an alternative embodiment of the fingertip protectors 10 intended for more heavy duty applications, such as masonry work. In this embodiment, the sleeve 12 is equipped with a first strip 40 of hook and loop fastening material which is fixedly attached (by adhesive, thermal bonding, or other means) to the exterior surface of the sleeve 12 and extends about 270° about the circumference of the sleeve 12 adjacent the open end 15 of the sleeve 12. The outer surface of the first strip 40 may bear either hook material or loop material 42. The sleeve 12 is also equipped with a second strip 44 of hook and loop fastening material which is elongated and generally rectangular in shape. The second strip 44 has a first end which is fixedly attached to the sleeve 12 (also by adhesive, thermal bonding, or other means) between the ends of the first strip 40. The second end of the second strip 44 is free, and the second strip 44 is sufficiently elongated that the strip may be pulled taut about the open end 15 of the sleeve 12 in order to reduce or eliminate any slack between the open end 15 of the sleeve 12 and the wearer's finger. The inner surface of the second strip 44 bears either loop or hook fastening material 46 so that it may be releasably fastened to the first strip 40. The outer surface of the second strip is preferably smooth. In this manner, the alternative embodiment shown in FIGS. 4 and 5 is reusable, being releasably secured to the wearer's finger by hook and loop fastening material.

It is to be understood that the present invention is not limited to the embodiments described above, but encompasses any and all embodiments within the scope of the following claims.

I claim:

1. A fingertip protector comprising:

a) a sleeve having a predetermined length and adapted for fitting over a fingertip of a wearer, said sleeve having:
   i) an open end;
   ii) a closed end;
   iii) an inner surface and an outer surface, the inner surface having a textured surface whereby a finger may slide easily into the sleeve; and b) finger attachment means for attaching said sleeve to a finger of a wearer, wherein said finger attachment means comprises:
   i) a first strip of hook and loop fastening material fixedly attached to the outer surface of said sleeve, the first strip having a first and second end, the first strip extending about 270° about the circumference of the sleeve adjacent the open end of the sleeve, the first strip having an outer surface with hook and loop fastening material disposed thereon; and
   ii) a second strip of hook and loop fastening material, the second strip having an inner surface having hook and loop fastening material disposed thereon for releasably attaching said second strip to said first strip, the second strip having a third and fourth end, the third end being fixedly attached to said sleeve between the first end and the second end of said first strip, the fourth end being elongated and aligned for wrapping about the circumference of the open end of said sleeve in order to fasten said second strip to said first strip and snugly secure the protector to a finger of the wearer.

* * * * *